United States Patent [19]

Goldberg

[11] Patent Number: 4,644,591

[45] Date of Patent: Feb. 24, 1987

[54] SOFT SCULPTURE FACE MASK

[76] Inventor: Mel Goldberg, c/o Topstone Industries, Inc., 2 Augusta Dr., Danbury, Conn. 06810

[21] Appl. No.: 766,949

[22] Filed: Aug. 19, 1985

[51] Int. Cl.[4] ..... A42B 1/18

[52] U.S. Cl. ..... 2/206; 446/27; 446/369

[58] Field of Search ..... 2/206, 173, 9; 446/27, 446/369, 372, 391; 206/575; D2/79, 240, 250

[56] References Cited

U.S. PATENT DOCUMENTS 2,705,803 4/1955 Sheldrick et al. ..... 446/369 X 3,129,001 4/1964 Winchell ..... 2/206 X 4,268,918 5/1981 Lee ..... 446/27 X 4,451,933 6/1984 Seng et al. ..... 2/206 X

*Primary Examiner*—Werner H. Schroeder

*Assistant Examiner*—Judith L. Olds

*Attorney, Agent, or Firm*—Mandeville and Schweitzer

[57] ABSTRACT

A soft sculpture face mask is extremely lightweight, breatheable and capable of being easily and inexpensively manufactured. The construction of the mask allows for an unlimited variety of face mask designs utilizing basically the same materials. The mask is three-dimensional and, therefore, more realistic than rubber molded masks which, in any event, are hot and uncomfortable to wear.

6 Claims, 5 Drawing Figures

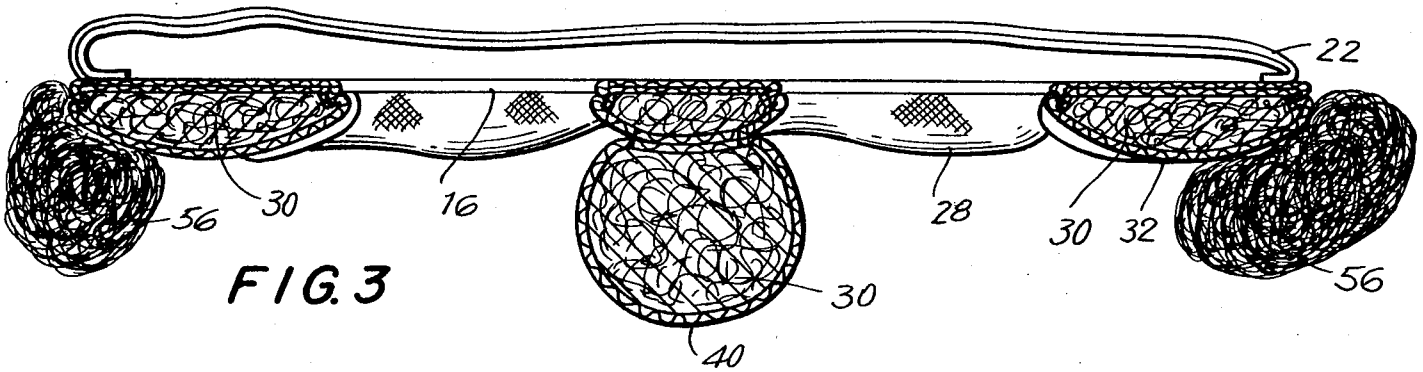
FIG. 3
FIG. 5
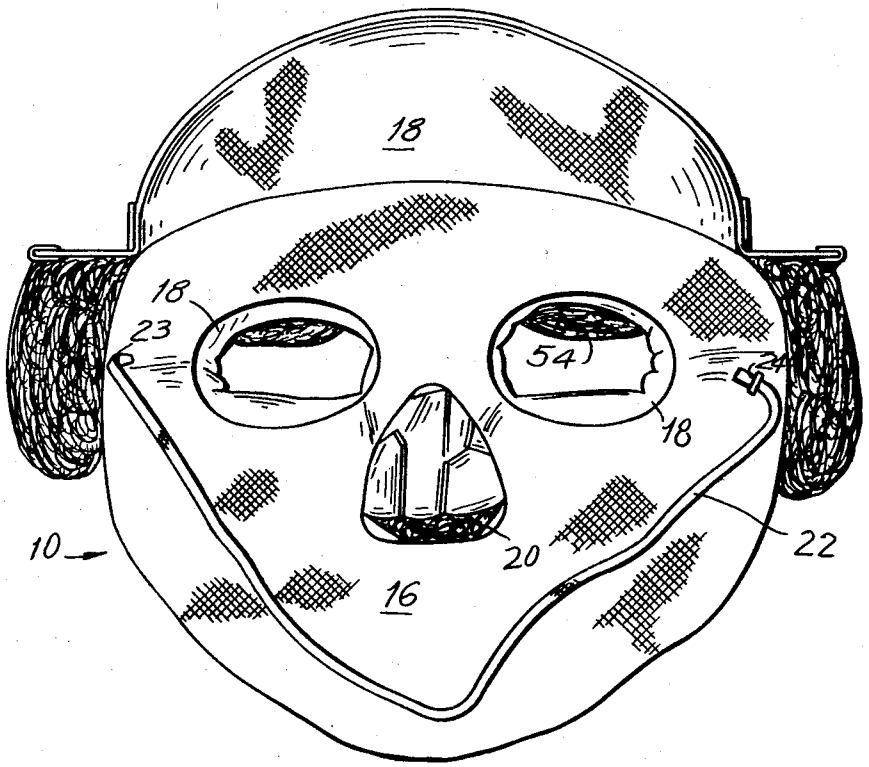
FIG. 4
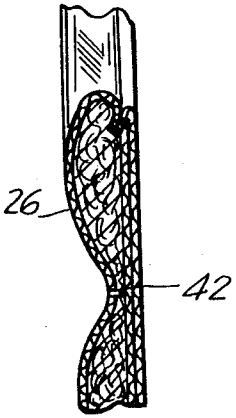

SOFT SCULPTURE FACE MASK

BACKGROUND OF THE INVENTION

The present invention relates to a face mask intended to be worn by a child or even an adult. More specifically, the present device is a soft sculpture face mask which presents a three-dimensional face mask design for hiding the actual physical features of the wearer. These face masks are extremely popular at Halloween parties, birthday parties, masquerade balls and are used in simple child play games. It is a desired object of these face masks to disguise the wearer's face and, yet, allow the wearer to easily see where he or she is going while the face mask is worn. It is another object of these face masks to allow them to be comfortably worn for extended periods of time since an uncomfortable face mask, when worn by a child, will be soon removed.

DESCRIPTION OF THE PRIOR ART

Face masks have been made for centuries. The prior art face masks are made from papier-mache, woodcarvings and, of late, from latex molds. All of these prior art face masks suffer from the initial disadvantage in that they are extremely hot, uncomfortable and relatively bulky to wear. In the case of a rubber-type face mask, the rubber composition is non-breathable, i.e., no air can pass through the mask and, therefore, when the mask is worn flush against the face of the wearer, it becomes uncomfortably hot for the wearer. Therefore, it is an object of the present invention to provide a face mask which is lightweight and, in addition, extremely comfortable to wear. The present invention is a three-dimensional, breathable and lightweight face mask. Furthermore, it is an object of the present invention to allow the wearer to easily see where he or she is going while wearing the mask. To this end, eye apertures are provided.

Prior art commercial face masks, i.e., those offered for sale in great numbers, and especially those of the rubber type which are formed in a mold, represent a single design image which can be multiply reproduced and offered for sale. It is another object of the present invention to provide an easy and relatively inexpensive face mask which can be commercially manufactured on a large scale with an unlimited number of design images or face characters utilizing basically the same materials for each face mask. The present invention accomplishes this and thereby provides basically unlimited individual face masks which can be commercially manufactured. In addition, the present invention eliminates the relatively costly machining and manufacturing of a mold for use in the rubber mask producing process.

The face masks of the prior art, in general, represent a thin rubber "skin" which, while extremely flexible (and, as previously mentioned, hot and uncomfortable to wear), does not truly represent a three-dimensional face and, therefore, is not as effective or as appealing a disguise as a three-dimensional face mask would otherwise be. Again, the present invention has, as a desired object, to provide a three-dimensional, individually configured face mask which is lightweight and breatheable and, yet, still allows the wearer to see where he or she is going.

These and other objects are sought to be accomplished by the present device.

SUMMARY OF THE INVENTION

The face mask represents a lightweight, fully breatheable, three-dimensional face mask which can be easily manufactured on a large scale with unlimited variety of face images. Obviously, individuals, when seeking to purchase face masks do not want to buy one if they suspect that a fellow friend going to the same party, ball or play event is also going to be wearing the identical face mask. However, with the present invention, that fear is totally eliminated inasmuch as truly individual face masks are provided, all with basically the same materials. Each of the face masks provided by the present device are three-dimensional and, therefore, represent a significant advance over the thin rubber "skin" face masks now prevalent in the prior art. In addition, of course, the present face mask provides eye apertures for allowing the wearer to see through the face mask.

The lightweightness of the face mask of the present device is also an extremely advantageous feature, as well as its breatheability, which allows the wearer to maintain the face mask in position for extended periods of time without the discomfort and heat normally associated with the rubber-type masks. The use of three-dimensional materials to create unique features on the face mask provides a more realistic and varied looking face mask and this, too, contributes to the overall attractiveness of the device.

The face mask of the present invention accomplishes the desired objects by the use of a flat backing layer, preferably felt, with a front nylon mesh "skin". Accumulated between the exterior "skin" and the backing layer is stuffing material, preferably in the form of cotton, which provides the face mask with its desired three-dimensionality and, in addition, minimizes the overall weight of the product while simultaneously allowing the entire face mask to be breatheable. By selectively accumulating the material in various areas of the face mask and then sewing the skin through the cotton material to the backing layer, a three-dimensional face mask is provided. Eye apertures are also cut into and through the backing layer and the front mesh skin to allow the wearer to see, while the face mask is worn. Additional disguise features can also be provided to the face mask for facilitating the overall aesthetic appearance of the device.

In the preferred embodiment of the present device, it is contemplated that the mask be a simple front face mask and, therefore, an elastic band is used for maintaining the mask on the wearer's head. Of course, it is possible that an over-the-head face mask can be provided, if desired.

BRIEF DESCRIPTION OF THE DRAWINGS

FIG. 3 is a cross sectional view of FIG. 1 taken along lines 3—3 thereof;

FIG. 4 is a partial cross sectional view of FIG. 1 taken along lines 4—4 thereof; and FIG. 5 is a rear view of the face mask.

Figure 1:
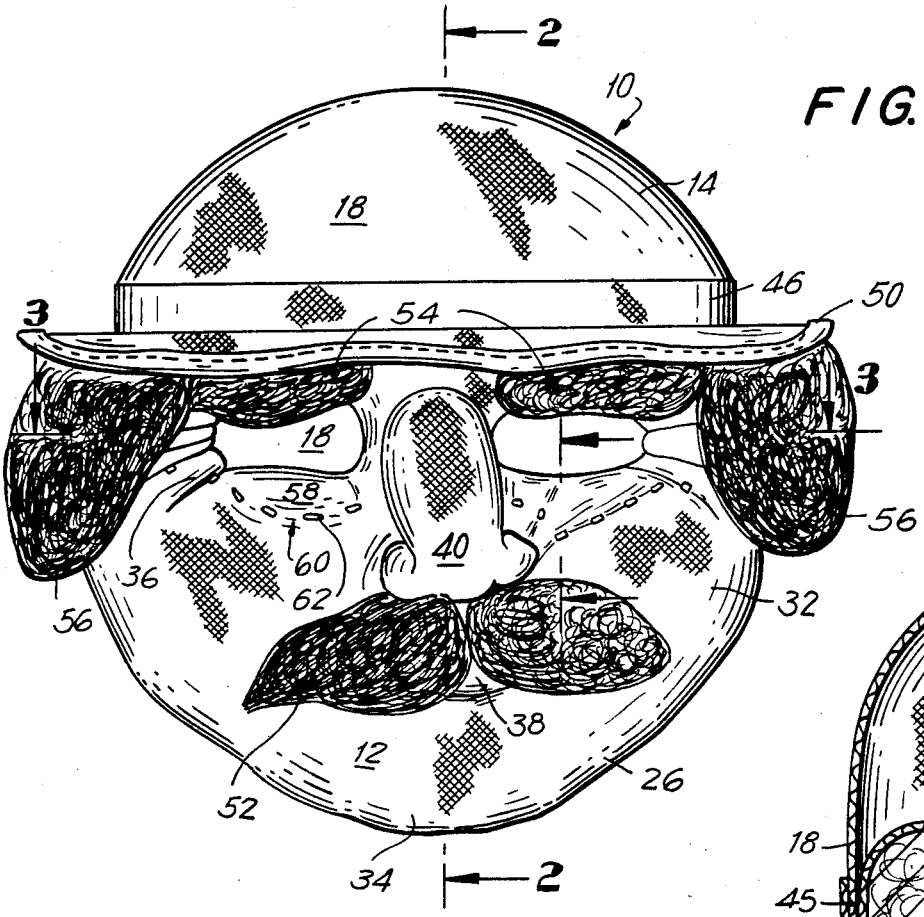
FIG. 1 is a front view of a first design of the face mask.

DETAILED DESCRIPTION OF THE INVENTION AND DESCRIPTION OF THE PREFERRED EMBODIMENT

The face mask, generally indicated as 10, consists of three basic sections, a three-dimensional front face section 12, an overlying hat section 14 and a rearwardly located mask support layer 16 (see FIG. 5). The mask support layer 16 basically corresponds to the planar projection of the three-dimensional face section 12. Mask support layer 16, preferably made of a felt-like substance, is provided with a pair of eye apertures or holes 18, such that the face mask 10, when worn by an individual, allows that individual full visibility. In addition, as can also be seen in FIG. 5, the mask support layer 16 is provided with a nose aperture or hole 20, centrally located in the support layer and slightly beneath eye apertures 18 which, of course, themselves, are located basically symmetrically along a vertical line, in much the manner as a normal face. In order to secure the face mask 10 to the wearer's head an elastic band 22 is sewn at two points, 23 and 24.

The face section 12 presents a three-dimensional surface and is, therefore, an extremely realistic yet artificial face mask. An outer "skin" 26 made of an elastic, nylon or stocking material substantially covers the entire outside surface of the face section 12. The skin 26, if made from a "natural" color woman's stocking, provides a realistic color for the face mask. The skin 26 is sewn or otherwise conventionally adhered to the outside perimeter of the support layer 16. Located between the inside surface of the skin 26 and the inside of the support layer 16 is a material accumulation pocket 28. The material accumulation pocket 28 is stuffed with a lightweight cotton-like material 30 which thereby gives the face mask 10 its three-dimensionality and, yet, maintains the lightweightness and breatheability of the overall mask. The material accumulation pockets 28 are selectively provided with accumulations of the cotton-like material 30, to give the face section 12 its desired realistic looking face; for example, more material 30 would be provided in the area of the face sections, cheeks 32 (see FIG. 1), than would be provided at the face section, chin 34. This, of course, depends upon the particular design of the face mask selected to be made and manufactured.

Figure 2:
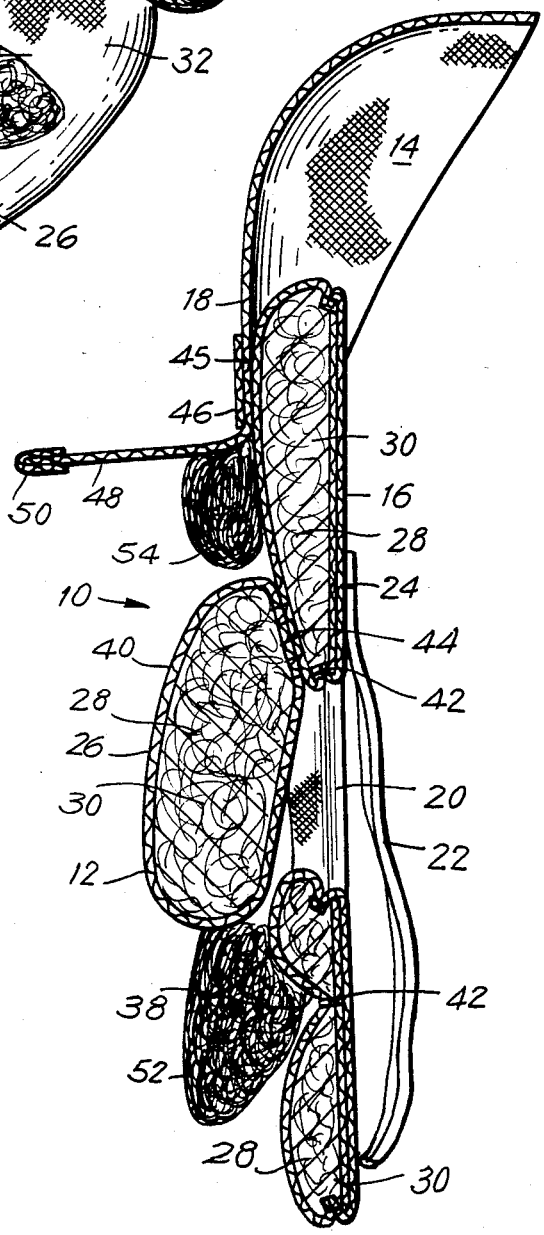
FIG. 2 is a cross sectional view of FIG. 1 taken along lines 2—2 thereof.

In addition, selected areas of the face mask 10, including the skin 26, the cotton-like material 30 and the support layer 16 can be sewn together, see, for example, crowsfeet 36 and lower lip 38 of FIG. 1, to provide additional design characteristics to the face mask. Also, whether as a wholly separate unit originally made and then sewn onto the face mask or whether integrally made along with the face section 12, itself, a nose 40 is provided which, too, consists of an outer skin 26 suitably shaped and selectively sewn, containing the cotton-like material 30 therein. As can be seen in FIGS. 2, 3 and 4, selected portions of the face mask 10 are sewn, indicated by stitches 42, which serve to increase the designability of the product and to give the mask superior, realistic looking features. FIG. 2 shows that the nose 40 is sewn at 44 to the face section 12 and protrudes downwardly and outwardly over the nose aperture or hole 20 in the support layer 16. Thus, when the mask is worn, the individual's nose will slightly protrude into the space created by the nose 40 and the nose aperture 20 and this, too, contributes to the overall comfort in wearing this face mask.

In accordance with this preferred embodiment of the present invention, a three-dimensional looking hat 14 made from a thin layer of felt material is attached to the top portion of the face section 12 by being stitched, glued or otherwise adhered to the skin 26 as at 45. The hat 14 has a ribbon 46 which serves a decorative function and, in addition, adds three-dimensional perspective. The hat is also provided with a brim 48 protruding forwardly and outwardly from ribbon 46 and the brim 48 has a finished edge 50 sewn around the edge of brim 48. In addition, this particular embodiment is provided with cotton-like hair, suitably brushed and colored to provide an artificial mustache 52, eyebrows 54 and side hair pieces 56.

Eye bags 58 are provided to this mask by selective sewing and accumulation of material within eye bag areas 60, which areas are delineated by sewn stitches 62.

Thus, as described, an artificial face mask is provided which is extremely lightweight and comfortable to wear, is breatheable, insofar as air and oxygen are allowed to circulate to the wearer's face and, therefore, the mask is extremely comfortable to wear. Furthermore, an extremely attractive three-dimensional mask is provided which can be manufactured with basically the same materials into a huge variety of individualized face masks, so that each face mask manufactured off an assembly line will basically appear as unique, i.e., one of a kind. Clearly, this is a highly desirable object. By selectively accumulating the material within the material accumulation pocket, defined as the area between the skin-like material 26 and the back support layer 16, and by selectively sewing those areas in place, the mask can be designed and configured as desired. In addition, it should also be appreciated that the use of the cotton material as the material accumulated within the pocket and the nylon or stocking material as the exterior skin of the mask, also allows cosmetic materials, e.g., blush, eyeliner, etc. to be used to further enhance the realistic looking features of the mask.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A face mask comprising:

(a) a relatively flat mask support layer having a pair of eye apertures;

(b) an air penetrable, face mask skin, made from elastic fabric and secured around its perimeter to said mask support layer and secured to said eye apertures around their perimeters;

(c) the area between said mask support layer and said face mask skin defining a three-dimensional stuffing pocket;

(d) a mass of lightweight, air penetrable stuffing material maintained in said stuffing pocket for providing three-dimensionality including depth to said face mask; and (e) at least one facial mask feature being provided to said face mask by selective accumulation of said stuffing material in selected areas of said stuffing product and securement of said face mask skin and said accumulated stuffing material to said mask support layer.

2. A face mask as claimed in claim 1, wherein:

(a) said mask support layer is felt.

3. A face mask as claimed in claim 1, wherein:

(a) said face mask skin is made from a women's stocking-type material.

4. A face mask as claimed in claim 1, wherein:

(a) said stuffing material is cotton.

5. A face mask as claimed in claim 1, wherein:

(a) at least one disguise feature is secured to said face mask skin.

6. A face mask as claimed in claim 1, wherein:

(a) said mask support layer is provided with a nose aperture.

* * * * *